US008393552B2

(12) United States Patent
Carels et al.

(10) Patent No.: US 8,393,552 B2
(45) Date of Patent: Mar. 12, 2013

(54) PREFABRICATED MODULE FOR A RAILWAY AND METHOD FOR MANUFACTURING THIS MODULE

(75) Inventors: Patrick Carels, Overijse (BE); M Joseph Rode, Grimbergen (BE)

(73) Assignee: Prefarails S.A., Soignies (BE)

( * ) Notice: Subject to any disclaimer, the term of this patent is extended or adjusted under 35 U.S.C. 154(b) by 28 days.

(21) Appl. No.: 12/599,836

(22) PCT Filed: May 12, 2008

(86) PCT No.: PCT/EP2008/055799

§ 371 (c)(1), (2), (4) Date: Nov. 12, 2009

(87) PCT Pub. No.: WO2008/138913

PCT Pub. Date: Nov. 20, 2008

(65) Prior Publication Data

US 2010/0294847 A1 Nov. 25, 2010

(30) Foreign Application Priority Data

May 11, 2007 (BE) ..... 2007/0233
Jul. 12, 2007 (EP) ..... 07112396

(51) Int. Cl.
*E01B 1/00* (2006.01)
*E01B 25/28* (2006.01)

(52) U.S. Cl. ..... 238/7

(58) Field of Classification Search ..... 238/2, 6, 238/7, 24, 25, 127, 128, 129
See application file for complete search history.

(56) References Cited

U.S. PATENT DOCUMENTS

| | | | | |
|---|---|---|---|---|
| 3,907,200 | A * | 9/1975 | Bernard | 238/7 |
| 5,163,614 | A * | 11/1992 | Tamas et al. | 238/2 |
| 5,513,797 | A * | 5/1996 | Lesley | 238/9 |
| 6,471,138 | B1 | 10/2002 | Blank et al. | |
| 7,484,669 | B2 * | 2/2009 | Gray, Jr. | 238/3 |
| 2004/0182946 | A1 * | 9/2004 | Reichel et al. | 238/5 |
| 2004/0221532 | A1 | 11/2004 | Shillington et al. | |

FOREIGN PATENT DOCUMENTS

| | | | |
|---|---|---|---|
| BE | 1014197 | A3 | 6/2003 |
| DE | 2347636 | A1 | 4/1975 |
| DE | 4439816 | A1 | 5/1996 |
| EP | 0603927 | A | 6/1994 |
| EP | 0922808 | A | 6/1999 |
| EP | 1496156 | A2 | 1/2005 |
| WO | 02066215 | A | 8/2002 |

* cited by examiner

*Primary Examiner* — S. Joseph Morano
*Assistant Examiner* — Zachary Kuhfuss
(74) *Attorney, Agent, or Firm* — Browdy and Neimark, PLLC

(57) ABSTRACT

Prefabricated module for manufacturing a railway which comprises (i) a railway bed element (1) with two standing lateral faces (4,5) situated opposite one another, a base (6) and a rail side (7) situated opposite the latter, whereby two parallel rails (8) are to be mounted or have been mounted on this rail side (7), (ii) a supporting element (2) with a bottom (14) and two opposite standing walls (15,16) defining a shaft in which the railway bed element (1) is situated, whereby said base (6) of the railway bed element (1) is provided opposite said bottom (14), and (iii) a vibration-insulating jacket (3) made of an elastic material, whereby this jacket (3) is provided between the railway bed element (1) and the supporting element (2), such that the railway bed element (1) does not make any direct contact with the supporting element (2).

20 Claims, 1 Drawing Sheet

PREFABRICATED MODULE FOR A RAILWAY AND METHOD FOR MANUFACTURING THIS MODULE

Figure 1:
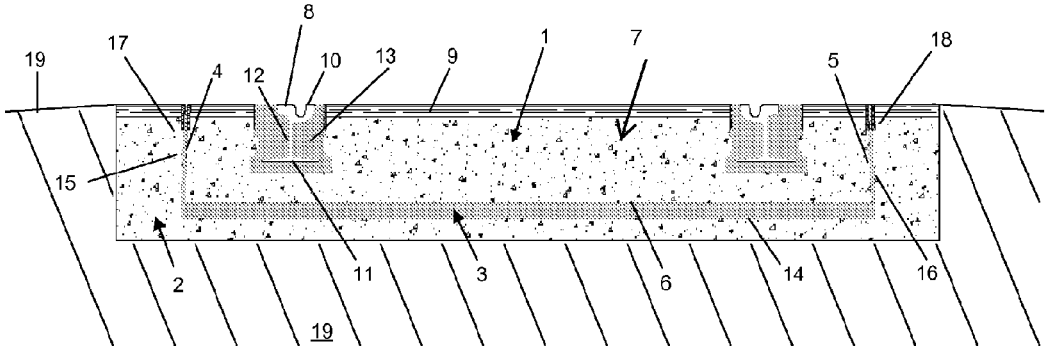

The invention concerns a prefabricated module for manufacturing a railway with a railway bed element with two standing opposite lateral surfaces, a base and a rail side situated opposite the latter, whereby two parallel rails are to be mounted or have already been mounted on this rail side.

According to the present state of the art, rails are enveloped in an elastic jacket and they are further embedded in a concrete railway bed, as is described for example in U.S. Pat. No. 6,471,138 B1, EP 1 496 156 A2 and BE 1014197 A3, so as to entirely disconnect them from the environment in an acoustic and also electrical manner.

Further, also the railway bed can be acoustically insulated as such by placing it on a mat formed of an elastic material. In this way is obtained what is called a floating track bed. The bottom side and the lateral surfaces of the track bed are hereby covered with an uninterrupted or continuous layer of elastic material, such that the railway bed is entirely acoustically disconnected from the enveloping substructure.

The floating track bed may possibly be a prefabricated reinforced-concrete module with rails that are embedded in an elastic jacket situated in a slot in this concrete module.

The installation of such floating track beds has some major disadvantages according to the present state of the art.

Thus, preparing the subsoil or substructure on which the elastic mat is to be provided is a critical phase when installing said floating track beds. Indeed, this substructure is decisive for a correct application of the elastic layer which determines the quality of the acoustic and vibration insulation. This preparation and the application of the elastic layer considerably slow down the installation of the railway.

Another disadvantage is that, during and after the installation, the uninterrupted elastic layer must be pierced so as to provide ducts for, for example, electric cables or drain pipes. These works often result in the formation of undesired acoustic bridges via which vibrations travel.

Another disadvantage is that the vertical rigidity of this floating track bed is influenced by the uninterrupted elastic layer on the lateral sides of the floating track bed.

The invention aims to remedy these disadvantages by providing a prefabricated module for a railway which enables a faster building of a railway with a floating track bed with less preparation of the substructure being required, whereby piercings in the uninterrupted or continuous elastic layer are avoided after the installation of the railway. Moreover, the invention aims to restrict the influence of the lateral sides of the floating track bed on the vertical rigidity or to even annul it altogether.

To this aim, the module according to the invention comprises a supporting element with a bottom and two opposite standing walls defining a shaft in which the railway bed element is situated, whereby said base of the railway bed element is provided opposite said bottom. Further, the module comprises a vibration-insulating jacket formed of an elastic material, whereby this jacket is provided between the railway bed element and the supporting element, such that the railway bed element does not make any direct contact with the supporting element, and whereby the railway bed element is mechanically enclosed or entrapped in the supporting element.

Practically, the distance between said standing walls of the supporting element is larger near said bottom than between the free edge of these walls opposite the bottom.

Advantageously, the maximum width of said railway bed element is at least equal to, or larger than, the minimum width of said shaft in the supporting element.

According to a preferred embodiment of the module according to the invention, at least one rail is embedded on the rail side of said railway bed element whose rail foot and, at least partially, whose rail body are enveloped with a vibration-insulating coating. This rail extends parallel to said lateral surfaces of the railway bed element.

According to a special embodiment of the module according to the invention, the sides of said walls of the supporting element that are turned towards each other and/or the lateral faces of the railway bed element are uneven, in particular ribbed, toothed, corrugated or provided with recesses or protrusions.

The invention also concerns a method for manufacturing a module for building a railway, whereby a railway bed element with two standing, opposite lateral faces, a base and a rail side situated opposite the latter are cast in concrete.

This method is characterised in that a vibration-insulating jacket is provided on said lateral faces and on the base of the thus obtained railway bed element, whereby a supporting element is cast in concrete over said jacket enveloping the railway bed element, whereas said rail side is directed down and said base is directed up.

According to an interesting embodiment of this method, two parallel rails are embedded in said rail side of the railway bed element, whose rail foot and, at least partially, whose rail body are enveloped with a vibration-insulating coating, and whereby these rails extend parallel to said lateral faces.

Other particularities and advantages of the invention will become clear from the following description of an embodiment of the method and the device according to the invention; this description is given as an example only and does not limit the scope of the claimed protection in any way; the figures of reference used hereafter refer to the accompanying drawings.

FIG. 1 schematically represents a cross section of a prefabricated floating slab track module according to a preferred embodiment of the invention.

Figure 2:
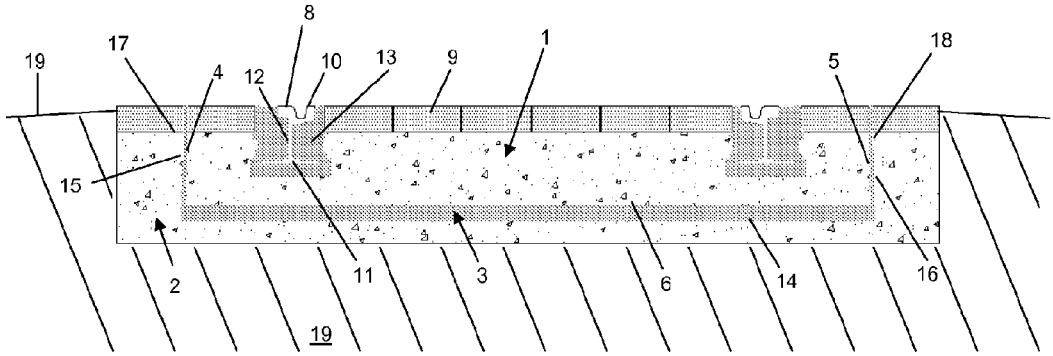

FIG. 2 schematically represents a cross section of a prefabricated module according to a variant of the embodiment from FIG. 1.

In the different drawings, the same figures of reference refer to identical or analogous elements.

The invention generally concerns a prefabricated module for building a railway with a floating track bed. Such a module, which is schematically represented in FIG. 1, comprises a railway bed element 1, a supporting element 2 and an acoustic and vibration insulating jacket 3 that insulates the railway bed element 1 from the supporting element 2. The module is placed on the subsoil or substructure 19.

The railway bed element 1 is formed of a concrete body in the shape of a prism having two opposite, standing lateral faces 4 and 5. Further, this railway bed element 1 comprises a base 6 and a rail side 7 situated opposite said base. On this rail side 7 have been mounted two parallel rails 8 extending in the longitudinal direction of the prefabricated module and which are thus parallel to the lateral faces 4 and 5.

On the rail side 7 is further provided a pavement 9 in the form of an asphalt layer. The rails 8 are hereby countersunk in the rail side of the railway bed element 1, such that the top side of the head 10 of the rails 8 is situated in the plane of the top side of the pavement 9. Thus, the foot 11 and at least a part of the body 12 of the rail is embedded in the concrete of the railway bed element 1. At least the part of the rail 8 which is countersunk in the railway bed element 1 is hereby enveloped with an acoustic and vibration-insulating rail insulation 13, such that there is no direct contact between the rail 8 and the concrete of the railway bed element 1. In the embodiment of the invention, as represented in FIG. 1, the entire foot 11, the body 12 and the lateral sides of the head 10 of the rail 8 are coated with an insulating material such as for example a rubber granule bonded by a polyurethane.

The embodiment of the prefabricated module according to the invention, which is represented in FIG. 2, differs from that in FIG. 1 in that the pavement 9 is formed of concrete tiles instead of asphalt.

Said supporting element 2 of the prefabricated module according to the invention has a bottom 14 and two opposite standing walls 15 and 16 which define a shaft in which the railway bed element 1 is situated. The base 6 of the railway bed element 1 is placed opposite said bottom 14. Consequently, said side walls 15 and 16 hereby extend along the corresponding lateral faces 4 and 5 of the railway bed element 1.

Between the railway bed element 1 and the supporting element 2 is provided said vibration-insulating jacket 3, such that there is no direct contact between both. This jacket 3 is preferably made of an elastic material such as for example rubber. Thus, the jacket 3 is formed for example of a mat that is composed of polyurethane bonded rubber granules.

The jacket 3 thus extends between said base 6 and said bottom 14 and between the lateral faces 4 and 5 and the respective walls 15 and 16. The jacket 3 hereby extends up to the top side of the pavement 9, such that the formation of an acoustic bridge between the railway bed element 1 and the supporting element 2 via said pavement is avoided, via which vibrations could propagate.

In this way, the railway bed element 1 is mounted in a floating manner in the supporting element 2.

The lateral faces 4 and 5 of the railway bed element 1 form an acute angle with the base 6 of the railway bed element 1. Thus, the distance between these lateral faces 4 and 5 gradually decreases as of the base 6 up to the rail side 7.

This makes sure that, when there is a vertical load on the railway bed element 1, the jacket 3 between the base 6 of the railway bed element 1 and the bottom 14 of the supporting element 2 can be compressed somewhat. The part of the jacket 3 between the standing walls 15 and 16 of the supporting element 2 and the lateral faces 4 and 5 of the railway bed element 1 will be extended, however, or it will come off the supporting element 2, such that the vertical rigidity of the floating track bed is not influenced by this part of the jacket 3.

The distance between said standing walls 15 and 16 of the supporting element 2 is thus larger near said bottom 14 than between the free edges 17, 18 respectively of said walls 15 and 16 situated opposite the bottom 14.

In particular, the distance between said walls 15 and 16 gradually decreases between said bottom 14 of the supporting element 2 and the free edges 17 and 18 of said walls 15 and 16 situated opposite the bottom.

Said shaft of the supporting element 2 has a trapezoidal cross section, whereby the side of this trapezium situated at said bottom 14 has a larger length than the opposite side of the trapezium.

The distance between the free edges 17 and 18 of said walls 15 and 16 opposite said bottom 14 is smaller than a distance between these walls 15 and 16 between the bottom 14 and said free edges 17 and 18.

In order to make it possible to handle the prefabricated module according to the invention, for example during its production, and to turn it around such that the module's top side is directed downward, the width of the base 6 of said railway bed element 1 is preferably at least equal to or larger than the distance between the free edges 17 and 18 of said supporting element 2 opposite said bottom 14.

In general, the maximum width of said railway bed element 1, either or not together with said jacket 3, is for example at least equal to or larger than the minimum width of said shaft in the supporting element 2.

Further, each of both lateral faces 4 and 5 of the railway bed element is advantageously practically parallel to the corresponding wall 15 and 16 of the supporting element 2.

In order to prevent the railway bed element 1 from moving in relation to the supporting element 2 in the longitudinal direction as a result of the load on the module caused, for example, by passing rail traffic, the lateral faces 4 and 5 of the railway bed element 1 are preferably made uneven. Thus, these lateral faces 4 and 5 may for example be ribbed, toothed or corrugated. In particular, these lateral faces 4 and 5 may be rough and possibly have all sorts of recesses and protrusions.

In the same manner, the opposite sides of said walls 15 and 16 of the supporting element 2 are preferably made uneven.

The vibration-insulating jacket 3 is then preferably connected in an almost fitting manner to the supporting element 2 and/or the railway bed element 1, such that the latter practically cannot undergo a permanent movement in relation to each other according to the longitudinal direction thereof.

Naturally, the rails 8 must not necessarily be pre-mounted in the prefabricated module, and these rails may possibly be mounted in or on the modules after they have been fit on the construction site. Thus, it is possible for the railway bed element 1 to have two parallel, longitudinal slots on the rail side thereof extending over the entire length of the railway bed element 1.

Further, piercings may be provided in the prefabricated module according to the invention so as to make it possible to provide for example a drain shaft for draining water from the rails 8 or from the pavement 9. Piercings may also be provided in the prefabricated module for connecting an electric conductor to the rails 8 or for installing electric signalling cables.

When building a railway whereby use is made of the above-mentioned prefabricated modules, these modules are placed on a substructure, such that the far ends of rails 8 that are mounted on the rail side 7 of the railway bed element 1 of every module are connected to one another. The far ends of the rails 8 preferably protrude from the railway bed element 1.

The free space that is hereby formed between successive modules under the connecting far ends concerned of the rails 8 are filled with concrete.

In particular, said free space is filled by placing an element made of concrete, with longitudinal recesses in its upper surface in which said far ends of the rails 8 fit, either or not enveloped with a vibration-insulating coating 13, in an almost fitting manner between said modules, such that the far ends of the rails 8 rest in these recesses. To this end, the element made of concrete is put under the rails and subsequently lifted until the rails 8 rest in the recesses.

Optimally, the free space in the recesses or gap between the vibration-insulating coating 13 and the element made of concrete, which may be present, is filled with concrete and/or elastic material. The elastic material can be poured in the gap after which it solidifies and/or the gap can be filled by inserting a, optionally elastic, wedge into it, such that the enveloped rail 8 fits closely in the recess.

The element made of concrete can further be built in the same manner as described above, namely from a railway bed element 1 and a supporting element 2 with a vibration-insulating jacket 3 in between.

In order to manufacture a prefabricated module, a railway bed element 1 with two standing opposite lateral faces 4 and 5, a base 6 and a rail side 7 lying opposite the later are cast in concrete in a first step.

On said lateral faces 4 and 5 and on the base 6 of the thus obtained railway bed element 1 is provided a vibration-insulating jacket 3.

Then, a supporting element 2 is cast in concrete over said jacket 3 enveloping the railway bed element 1. Said rail side 7 of the railway bed element 1 is hereby directed downward, and said base 6 is directed up.

As soon as the railway bed element 1 and the supporting element 2 have cured, the thus prefabricated module is turned around as a whole, such that the rail side 7 is directed up.

When casting the railway bed element 1, in certain cases, at least one rail 8 whose rail foot 11 and, at least partially, whose rail body 12 are enveloped with a vibration-insulating coating 13, is embedded in said rail side 7, whereby this rail 8 extends parallel to said lateral faces 4 and 5.

The jacket 3 is preferably at least partially uneven, in particular corrugated, at the lateral faces 4 and 5 of the railway bed element 1 and/or the inside of the standing side walls 15 and 16 of the supporting element 2, as a result of which a better bond of the concrete to this jacket is obtained.

Further, it may be interesting to provide openings for piercings or to actually provide piercings in said railway bed element 1 and/or in said supporting element 2 for drainage ducts or electric cables. This can be done for example by placing a body such as a pipe in the position of such bore holes before any concrete is cast, whereby it is preferably made sure that this body is not filled with concrete.

According to a preferred embodiment of the method of the invention, the module is made in mainly three steps whereby the module is cast upside down in a curing material such as concrete, i.e. with the upper side, which is also the rail side 7, down.

In a first step, the concrete railway bed element 1 is formed. A formwork is used to this end, which may also be provided with a reinforcement and which is filled with concrete.

On the bottom side, this formwork is provided with two parallel, beam-shaped elements running over the entire length of the formwork and forming slots for the rails 8. These beam-shaped elements can be positioned very precisely such that the slots for the rails will be perfectly positioned in the railway bed element 1. The lateral sides of the formwork are directed outward in a slanting manner, such that the upper side of the formwork is larger than the bottom side, and such that this formwork has a trapezoidal cross section. Optionally, the sides are corrugated, as a result of which corrugated oblique lateral faces 4 and 5 for the concrete railway bed element 1 are formed.

As soon as the concrete has cured and the formwork has been removed, an elastic vibration-insulating layer 3 is provided in a second step on the bottom side and the lateral sides of the concrete railway bed element 1 which fits up entirely to this concrete railway bed element 1.

According to a possible variant, a corrugated elastic vibration-insulating layer is provided on the sides of the formwork before the concrete is cast in the formwork.

In a third step, a formwork for the supporting element 2 is provided round the railway bed element 1 with the elastic vibration-insulating jacket 3 which forms a part of the formwork for this supporting element 2 as such. The formwork may be provided with a reinforcement and it is filled with concrete. The elastic vibration-insulating jacket 3 is corrugated, such that the sides of the walls 15 and 16 of the supporting element 2 that are turned towards each other are corrugated as well.

As the jacket 3 is uneven, for example corrugated, the cast concrete of the railway bed element 1 and the supporting element 2 will adhere better to this jacket 3.

The slanting lateral faces 4 and 5 of the railway bed element 1 result in slanting, inwardly turned, standing side walls 15 and 16 of the supporting element 2 which embed the railway bed element 1. This makes it possible to simply turn the module upside down after the concrete has cured. This is not unimportant for the transport of the module.

According to a variant of this method, rails that are embedded in an elastic jacket are already provided in the first step. As such the beam-shaped elements can contain the rails that are enveloped in an elastic jacket. Thus, a module is produced, which already contains such rails embedded in said slots.

In a very advantageous embodiment of the method of the invention, the vibration insulating jacket 3 consists of a mat of elastic material such as recycled rubber. As soon as the concrete has cured and the formwork has been removed, the mat is provided in the second step on the bottom side 6 and the lateral sides 4 and 5 of the concrete railway bed element 1 and fits up entirely to this concrete railway bed element 1. The mat does not need to be bound to the railway bed element 1.

In a third step, a formwork for the supporting element 2 is provided round the railway bed element 1 and the mat. The formwork is, subsequently, filled with concrete. The mat, which fits up to the railway bed element 1 and the supporting element 2, is enclosed between these two elements 1 and 2. Therefore, it does not need to be bound to the railway bed element 1 or the supporting element 2.

Optionally, the mat can be corrugated, such that the sides of the walls 15 and 16 of the supporting element 2 that are turned towards each other are corrugated as well. This will result in a better adherence between the mat and the supporting element 2 and will also avoid a possible horizontal shift of the railway bed element 1 in shaft of the supporting element 2.

The slanting lateral faces 4 and 5 of the railway bed element 1 result in slanting, inwardly turned, standing side walls 15 and 16 of the supporting element 2 which embed the railway bed element 1. Hence, the railway bed element 1 is mechanically entrapped in the supporting element 2. This makes it possible to simply turn the module upside down after the concrete has cured. This is not unimportant for the handling and transport of the module.

It is clear that the railway bed element 1 can be entrapped in the supporting element 2 by other means such as, e.g. discrete or continuous slots and/or protrusions that are provided in the lateral faces 4 and 5 of the railway bed element 1 and/or the standing side walls 15 and 16 of the supporting element 2.

The fact that, in the above method, the module is manufactured upside-down has the advantage that, in an initial step before the above first step, the rails can be placed on the ground. This allows an easy and very accurate positioning of the rails. Moreover, this also allows the set up of more complex configurations of the rails such as e.g. railway switches and turns.

The mat consists of a flat piece in the form of a sheet made of insulating material such as recycled rubber or a fabric of insulating material.

The advantage of using a mat of insulating material such as recycled rubber is that this mat is relatively easy and cheap to manufacture compared to e.g. an insulating coating poured around the railway bed element 1. The mat can be cut in the right shape such that it fits to the railway bed element 1.

Another advantage of the use of a mat is that it is not bound to the railway bed element 1 and/or the supporting element 2. A vertical load on the railway bed element 1 will compress somewhat the mat 3 between the base 6 of the railway bed element 1 and the bottom 14 of the supporting element 2. The part of the mat 3 between the standing walls 15 and 16 of the supporting element 2 and the lateral faces 4 and 5 of the railway bed element 1 will easily come off from the supporting element 2 since it is not bound to this element 2. Hence, the vertical rigidity of the floating track bed will not be influenced by this part of the mat 3, which forms an uninterrupted elastic layer on the lateral sides of the floating track bed.

Naturally, the invention is not restricted to the above-described method and the module represented in the accompanying drawings. Thus, said lateral faces 4 and 5 of the supporting element of the walls 15 and 16 of the supporting element 2 must not necessarily be straight, for example, and they can be made in a bent shape, for example.

Nor is it necessary for the rails 8 to be mounted in a countersunk manner on the rail side 7 of the railway bed element 1. These rails can for example also be fixed on top of the railway bed element 1, on its rail side.

The slanting lateral faces 4 and 5 of the railway bed element 1 may possibly be flat, and the standing walls 15 and 16 of the supporting element 2 may be uneven or corrugated, and the vibration-insulating jacket 3 has a flat side and a corrugated side, such that this jacket fits onto the flat, slanting lateral faces 4 and 5 of the railway bed element 1 on the one hand, and on the corrugated standing walls 15 and 16 of the supporting element 2 on the other hand.

Further, a railway bed element must not necessarily comprise two rails, but it is also possible to provide only one rail on a railway bed element. Thus, two prefabricated modules must be mounted next to each other so as to install a railway with two tracks.

The invention claimed is:

1. A prefabricated module for manufacturing a railway, comprising:

(i) a railway bed element with two standing lateral faces situated opposite one another, a base and a rail side situated opposite one another, said rail side being provided for receiving two parallel rails to be mounted therein such that the rails are continuously supported by the railway bed element, (ii) a supporting element with a bottom, an upper surface and two opposite standing walls defining a shaft, extending along a full length of the supporting element, in which the railway bed element is situated, said standing walls each extending from said bottom up to free edges situated at said upper surface, wherein said base of the railway bed element is provided opposite said bottom of the supporting element, and wherein a first distance between said standing walls of the supporting element is larger near said bottom than between said free edges of said standing walls, (iii) a vibration-insulating jacket made of an elastic material, said jacket being provided between the railway bed element and the supporting element, such that the railway bed element does not make any direct contact with the supporting element, said the railway bed element being embedded in the supporting element such that said railway bed element is mechanically enclosed in supporting element.

2. The prefabricated module according to claim 1, whereby said shaft in the supporting element has a trapezoidal cross section, having a side situated on said bottom that has a larger length than an opposite side of this cross section.

3. The prefabricated module according to claim 1, wherein a second distance extending between said walls gradually decreases in a direction extending from said bottom of the supporting element towards said free edge of said walls.

4. The prefabricated module according to claim 1, wherein a width of the base of said railway bed element is at least equal to or larger than a third distance extending between said free edges of said supporting element opposite said bottom.

5. The prefabricated module according to claim 1, whereby the maximum width of said railway bed element (1), including or not including said jacket (3) is at least equal to or is larger than the minimum width of said shaft in the supporting element (2).

6. The prefabricated module according to claim 1, wherein a height of each of both lateral faces of the railway bed element is practically equal to a corresponding wall of the supporting element.

7. The prefabricated module according to claim 1, wherein said railway bed element has two parallel, longitudinal slots on the rail side extending over an entire length of the railway bed element.

8. The prefabricated module according to claim 7, wherein one of said two rail rails is mounted in each of said slots.

9. The prefabricated module according to claim 1, wherein at least one rail of the two rails has a rail foot and a rail body, and said at least one rail and at least part of said rail body are enveloped with a vibration-insulating coating, is embedded on the rail side of said railway bed element, and wherein said at least one rail extends parallel to said lateral faces of the railway bed element.

10. The prefabricated module according to claim 1, wherein top ends of said two rails protrude in relation to the railway bed element.

11. The prefabricated module according to claim 1, wherein said jacket connects to the supporting element and/or to the railway bed element in a fitting manner.

12. The prefabricated module according to claim 1, wherein the vibration-insulating jacket consists of a mat of vibration-insulating material that fits up to the railway bed element and the supporting element.

13. The method for installing a railway, wherein prefabricated modules according to claim 1 are placed on a base and wherein top ends of rails that are mounted on the rail side of the railway bed element of each module and that protrude in relation to the railway bed element are connected to each other.

14. The method according to claim 13, wherein said top ends of the rails are enveloped with a vibration-insulating coating, after which free space in the prefabricated modules is filled with concrete.

15. The method according to claim 13, whereby said free space is filled by putting an element made of concrete, having a top having longitudinal recesses, wherein said top ends of the rails fit in said longitudinal recesses.

16. A method for manufacturing a module for installing a railway, wherein a railway bed element with two standing lateral faces situated opposite each other, a base and a rail side, the base being situated opposite the rail side and being cast in concrete, wherein a vibration-insulating jacket, such as a mat made of a vibration-isolating material, is provided on said lateral faces and on the base of the thus obtained railway bed element, whereby a supporting element is cast in concrete over said jacket at least partially enveloping the railway bed element while said rail side is directed downwardly and said base is directed upwardly.

17. The method according to claim 16, further comprising embedding, in said rail side of the railway bed element two parallel rails having a rail foot and a rail body, and covering the rail foot and at least a part of the rail body with a vibration-insulating coating, and wherein said rails extend parallel to said lateral faces.

18. The method according to claim 17, top ends of each of said rails protrude in relation to said railway bed element.

19. The method according to claim 16, whereby openings for piercings are provided or piercings are actually provided in said railway bed element and/or in said supporting element for drainage ducts or electric wires.

20. A railway, wherein said railway is installed as a series of the modules of claim 1.

* * * * *